US008756723B2

(12) United States Patent
Loyd et al.

(10) Patent No.: US 8,756,723 B2
(45) Date of Patent: Jun. 24, 2014

(54) SPA JET WITH SIDE-MOUNTED LIGHT WELL

(75) Inventors: Casey Loyd, Pomona, CA (US); Robert Santos, Pomona, CA (US); Pedro Vargas, Pomona, CA (US)

(73) Assignee: Lloyds IP Holdings, LLC, Pomona, CA (US)

( * ) Notice: Subject to any disclaimer, the term of this patent is extended or adjusted under 35 U.S.C. 154(b) by 427 days.

(21) Appl. No.: 13/094,047

(22) Filed: Apr. 26, 2011

(65) Prior Publication Data

US 2012/0174312 A1 Jul. 12, 2012

Related U.S. Application Data

(60) Provisional application No. 61/440,016, filed on Feb. 7, 2011, provisional application No. 61/431,714, filed on Jan. 11, 2011.

(51) Int. Cl.
*A61H 33/00* (2006.01)

(52) U.S. Cl.
USPC ..... 4/541.6

(58) Field of Classification Search
USPC ..... 4/541.1–541.6
See application file for complete search history.

(56) References Cited

U.S. PATENT DOCUMENTS

| | | | | | |
|---|---|---|---|---|---|
| 4,340,039 | A * | 7/1982 | Hibbard et al. | ..... | 601/157 |
| 5,180,103 | A * | 1/1993 | Harrison et al. | ..... | 239/1 |
| 5,256,090 | A * | 10/1993 | Woolley | ..... | 440/40 |
| 5,742,953 | A * | 4/1998 | Loizeaux et al. | ..... | 4/541.1 |
| 5,752,282 | A * | 5/1998 | Silveri | ..... | 4/541.1 |
| 5,943,711 | A * | 8/1999 | Loizeaux et al. | ..... | 4/541.6 |
| 6,760,931 | B1 * | 7/2004 | Mattson et al. | ..... | 4/541.1 |
| 6,971,125 | B2 * | 12/2005 | Mattson et al. | ..... | 4/541.1 |
| 7,203,977 | B2 * | 4/2007 | Mattson et al. | ..... | 4/541.1 |
| 2004/0168248 | A1 * | 9/2004 | Mattson et al. | ..... | 4/541.1 |
| 2004/0205888 | A1 * | 10/2004 | Mattson et al. | ..... | 4/541.1 |
| 2005/0183199 | A1 * | 8/2005 | Mattson et al. | ..... | 4/541.1 |
| 2005/0283902 | A1 * | 12/2005 | Mattson et al. | ..... | 4/541.1 |
| 2007/0186339 | A1 * | 8/2007 | Mattson et al. | ..... | 4/541.1 |
| 2009/0276952 | A1 * | 11/2009 | Wooten | ..... | 4/541.6 |

* cited by examiner

*Primary Examiner* — Lori Baker
(74) *Attorney, Agent, or Firm* — Thomas A. Runk; Fulwider Patton LLP

(57) ABSTRACT

A water jet suitable for use in a water recreational apparatus has (a) a body defining a body interior passageway between a body inlet opening and a body outlet opening, the body having (a) a light well with an open external end and a closed transparent internal end, and (b) an insert disposed largely within the body, the insert defining an insert interior passageway between an insert inlet opening and an insert outlet opening, the insert defining a flange cover at the proximal end of the insert. The insert is moveable within the body between a water open position and a water closed position. The insert is also moveable within the body between a light on position and a light off position.

18 Claims, 4 Drawing Sheets

SPA JET WITH SIDE-MOUNTED LIGHT WELL

FIELD OF THE INVENTION

This invention relates generally to water recreational apparatuses such as portable spas, fitness spas, hot tubs, whirlpool bathtubs, swimming pools, portable swimming pools, and, more specifically, to water jets useable in such water recreational apparatuses.

BACKGROUND OF THE INVENTION

Water jets are commonly used in a wide variety of water recreational apparatuses to discharge a pleasant stream of water onto occupants within such water recreational apparatuses.

FIG. 1 illustrates a water jet of the prior art wherein a light, such as an LED light, is adapted to project light through the proximal end of the jet (the end of the jet from which water is discharged into the water recreational apparatus). As can be seen in FIG. 1, such water jet of the prior art uses a relatively long light well disposed axially from the distal end of the jet within the water flow path.

The light well in the prior art jet of FIG. 1 creates several problems. One problem is that the light well tends to create leaking problems where the light well enters the water flow path at the rear of the jet. A second problem is that the insertion of the light well into the water flow path seriously inhibits the flow of water therethrough.

Accordingly, there is a need for a water jet suitable for use in a water recreational apparatus which can project light through the proximal end of the jet, but which avoids the aforementioned problems in the prior art.

SUMMARY OF THE INVENTION

The invention satisfies this need. The invention is a water jet suitable for use in a water recreational apparatus. The water jet comprises (a) a body having a distal portion terminating at a distal end of the body and a proximal portion terminating at a proximal end of the body, the body defining a body interior passageway between a body inlet opening in the distal portion of the body and a body outlet opening in the proximal portion, the proximal portion of the body defining a peripheral flange at the proximal end of the body, the peripheral flange surrounding the body outlet opening, the body further defining a light well, having an open external end and a closed transparent internal end, and (b) an insert attached to the body, the insert having a distal portion terminating at a distal end of the insert and a proximal portion terminating at a proximal end of the insert, the insert defining an insert interior passageway between an insert inlet opening in the distal portion of the insert and an insert outlet opening in the proximal portion of the insert, the insert defining a flange cover at the proximal end of the insert, the distal portion of the insert being disposed within the interior passageway of the body with the flange cover disposed over the flange of the body. In the invention, the insert is moveable within the body between (1) a water open position, wherein water is allowed to flow between the body inlet opening and the insert outlet opening, and (2) a water closed position, wherein water is prevented from flowing between the body inlet opening and the insert outlet opening. Also in the invention, the insert is moveable within the body between (1) a light on position, wherein light is allowed to flow between the light well and the proximal portion of the insert, and (2) a light off position, wherein light is blocked from flowing between the light well and the proximal portion of the insert.

DRAWINGS

These and other features, aspects and advantages of the present invention will become better understood with reference to the following description, appended claims and accompanying drawings where:

DETAILED DESCRIPTION OF THE INVENTION

Figure 1:
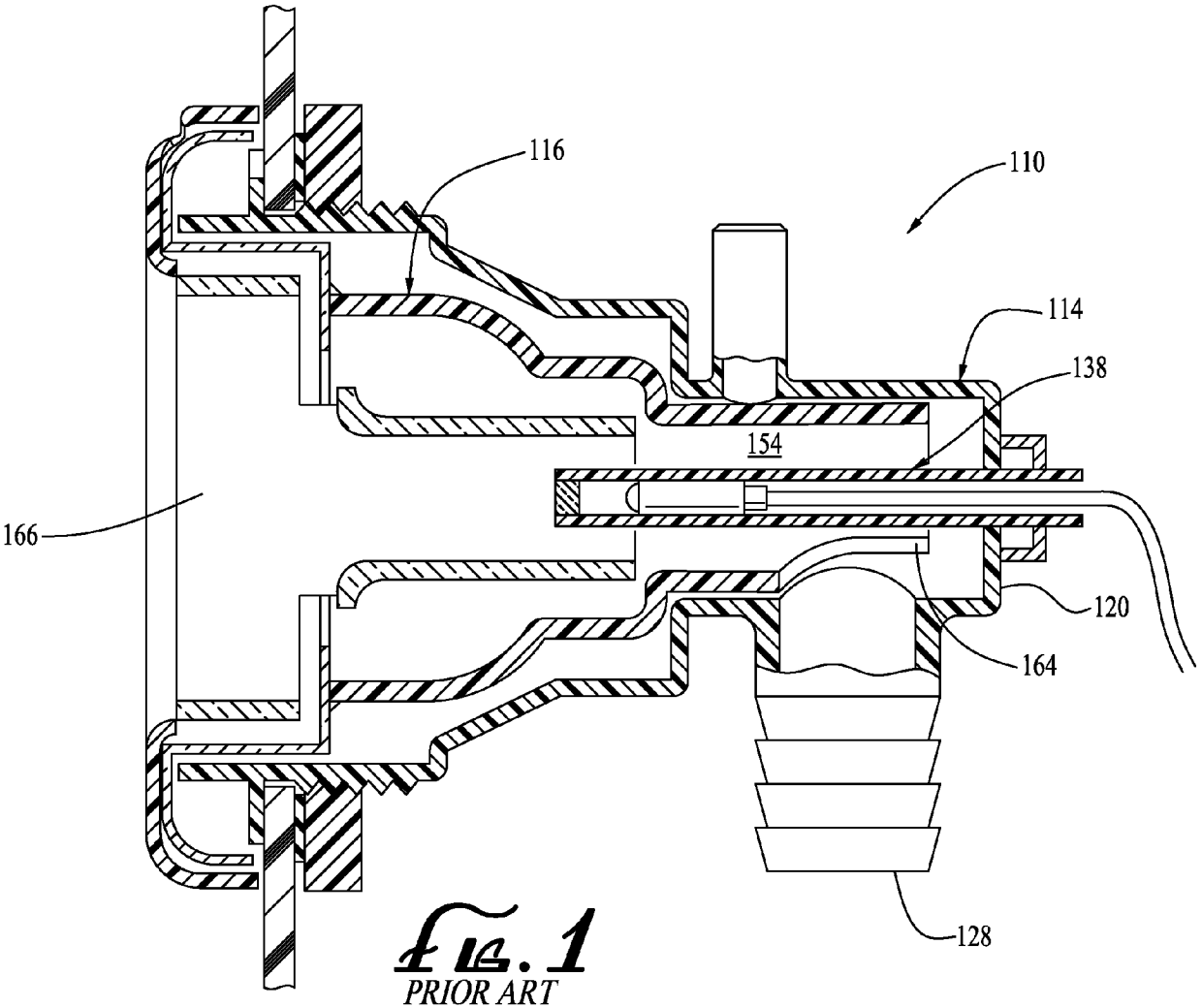
Fig. 1 PRIOR ART
FIG. 1 is a cross-sectional view of a water recreational apparatus jet of the prior art.
Figure 2:
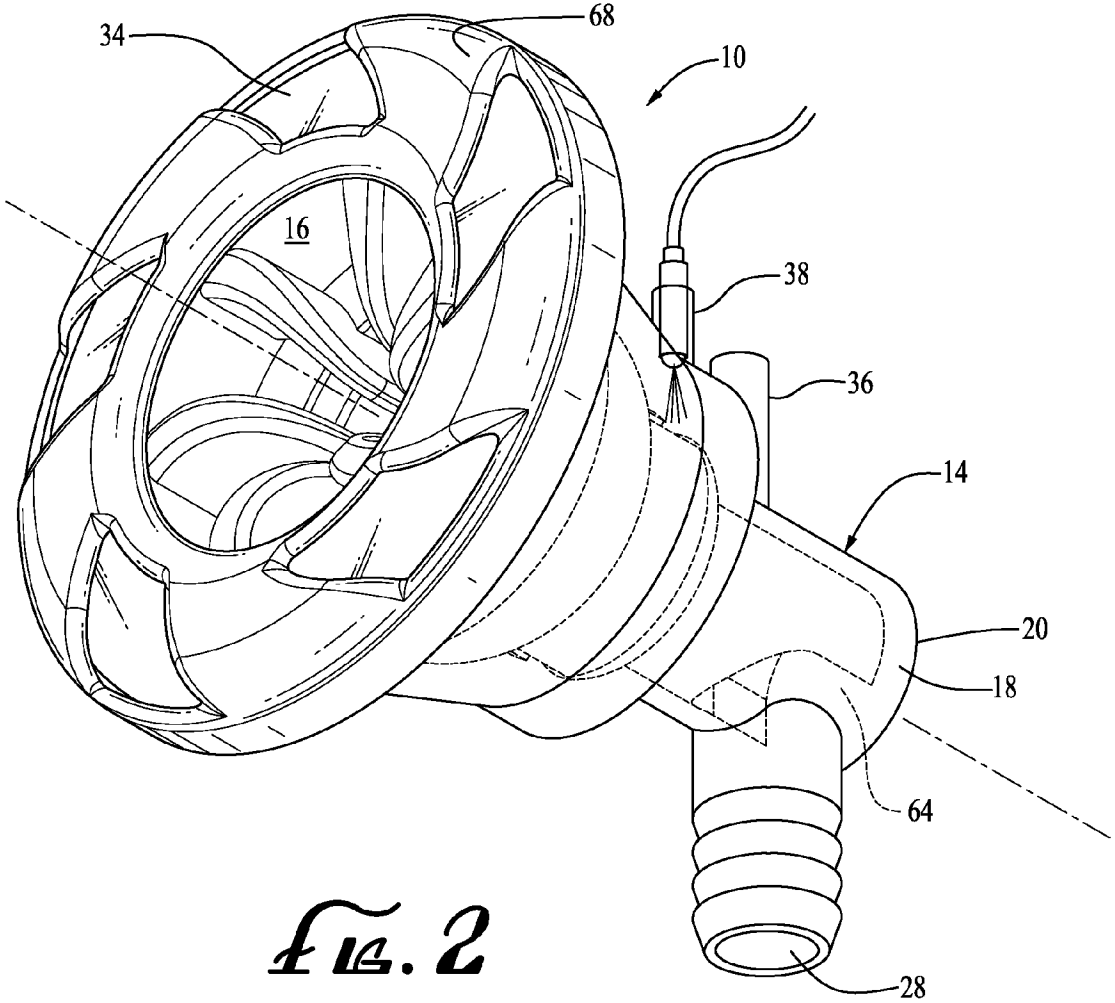
FIG. 2 is a perspective view of a water recreational apparatus jet having features of the invention, showing the proximal end of the jet.

The following discussion describes in detail one embodiment of the invention and several variations of that embodiment. This discussion should not be construed, however, as limiting the invention to those particular embodiments. Practitioners skilled in the art will recognize numerous other embodiments as well.

The invention is a water jet 10 suitable for use in a water recreational apparatus 12. By "water recreational apparatus," it is meant all water recreational apparatuses employing inlet jets, including, but not limited to, portable spas, fitness spas, hot tubs, whirlpool bathtubs, swimming pools and portable swimming pools.

The water jet 10 of the invention comprises a body 14 and an insert 16 attached to the body 14. The body 14 is typically made from a plastic material and can be either opaque or translucent. By "translucent," it is meant in this application to include materials through which light can pass, including materials commonly termed "transparent."

The body 14 has a distal portion 18 terminating at a distal end 20 of the body 14 and a proximal portion 22 terminating at a proximal end 24 of the body 14. The body 14 defines a body interior passageway 26 between a body inlet opening 28 in the distal portion 18 of the body 14 and a body outlet opening 30 in the proximal portion 22 of the body 14. The body 14 is typically elongate and has a longitudinal axis 32.

The proximal portion 22 of the body 14 defines a peripheral flange 34 at the proximal end 24 of the body 14. The peripheral flange 34 surrounds the body outlet opening 30.

The body 14 includes an air inlet port 36 for allowing the input of pressurized air into the body 14.

The body 14 further defines a light well 38, having an open external end 40 and a closed transparent end 42. The light well 38 is typically disposed along the side of the body 14 at an angle generally perpendicular to the longitudinal axis 32 of the body 14. In the embodiment illustrated in the drawings, the light well 38 is sized and dimensioned to accept an LED 44. In other embodiments, the light well 38 can be sized and dimensioned to accept a standard light bulb, or sized and dimensioned to accept the end of a fiber optic fiber.

In one embodiment, the body 14 comprises a translucent area 46 in the flange 34 and a translucent passageway 48 between the light well 38 and the translucent area 46 in the flange 34. In a typical embodiment, the body 14 is made entirely from a translucent material, so that the entire flange 34 constitutes a translucent area 46 in the flange 34 and so that the entire area of the body 14 constitutes a translucent passageway 48 between the light well 38 and the translucent area 46 of the flange 34.

Another way of providing illumination in the invention, as illustrated in the drawings, is to mold the jet body 14 from an opaque material, and to then drill a hole through the body 14 and insert a clear seal 50, so that light can travel through the light well 38 to the interior of the body 14.

The insert 16 is also typically made from a plastic material and can also be either opaque or translucent. In the embodiment illustrated in the drawings, the insert 16 is made from an opaque material and has an insert lateral aperture 52 which can be moved adjacent the light well 38 to allow light from the light well 38 to enter an insert interior passageway 54.

The insert 16 has a distal portion 56 terminating at a distal end 58 of the insert 16 and a proximal portion 60 terminating at a proximal end 62 of the insert 16. The insert 16 defines the insert interior passageway 54 between an insert inlet opening 64 in the distal portion 56 of the insert 16 and an insert outlet opening 66 in the proximal portion 60 of the insert 16.

The insert 16 also defines a flange cover 68 at the proximal end 62 of the insert 16. The flange cover 68 is sized and dimensioned to cover the flange 34 of the body 14.

The distal portion 56 of the insert 16 is disposed within the interior passageway 26 of the body 14 with the flange cover 68 disposed over the flange 34 of the body 14.

Figure 3:
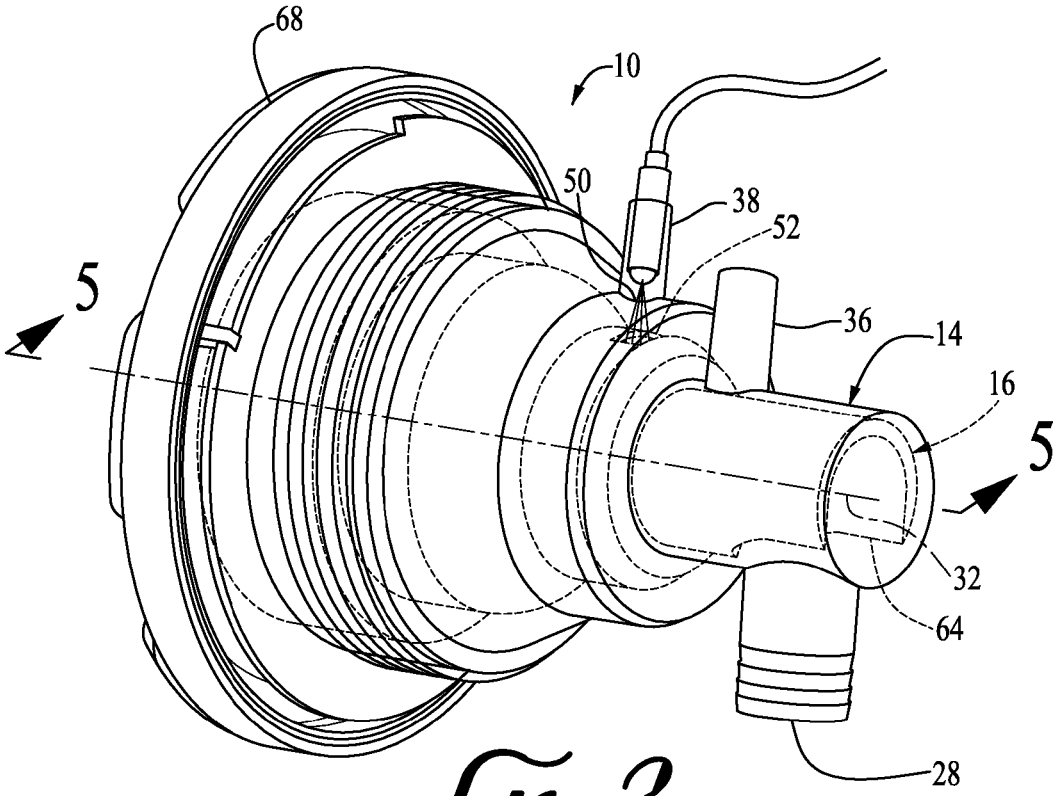
FIG. 3 is a second perspective view of the water recreational apparatus jet illustrated in FIG. 2, showing the distal end of the jet
Figure 4:
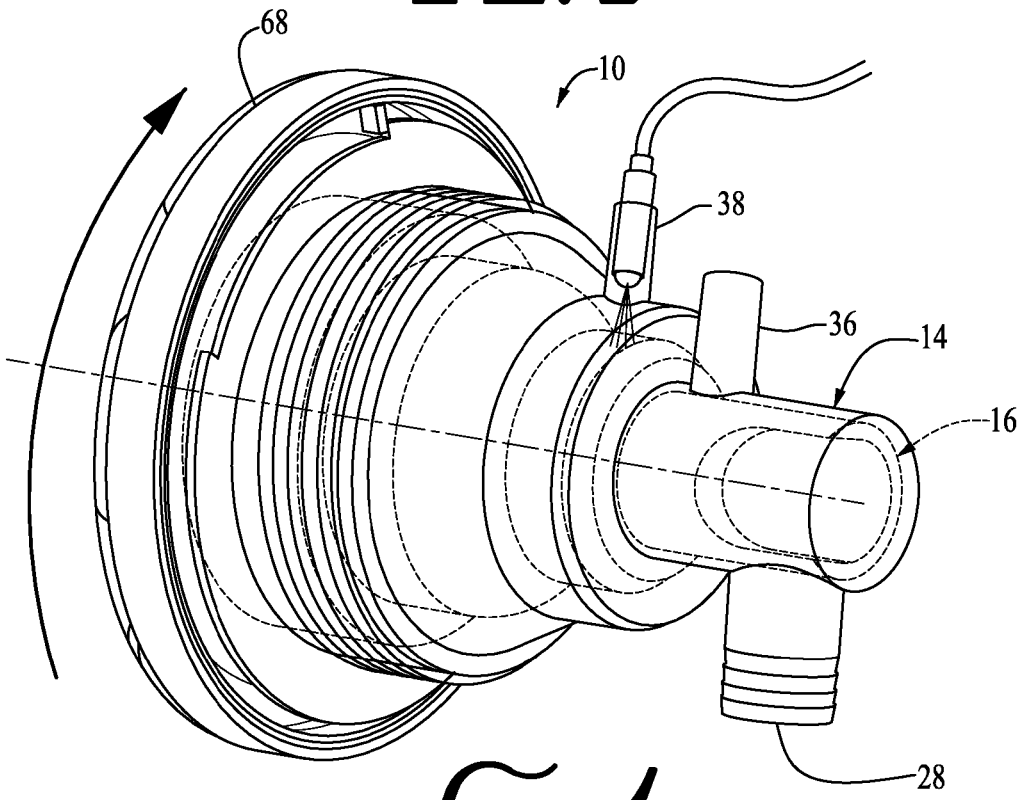
FIG. 4 is a third perspective view of the water recreational apparatus jet illustrated in FIG. 2, also showing the distal end of the jet.
Figure 5:
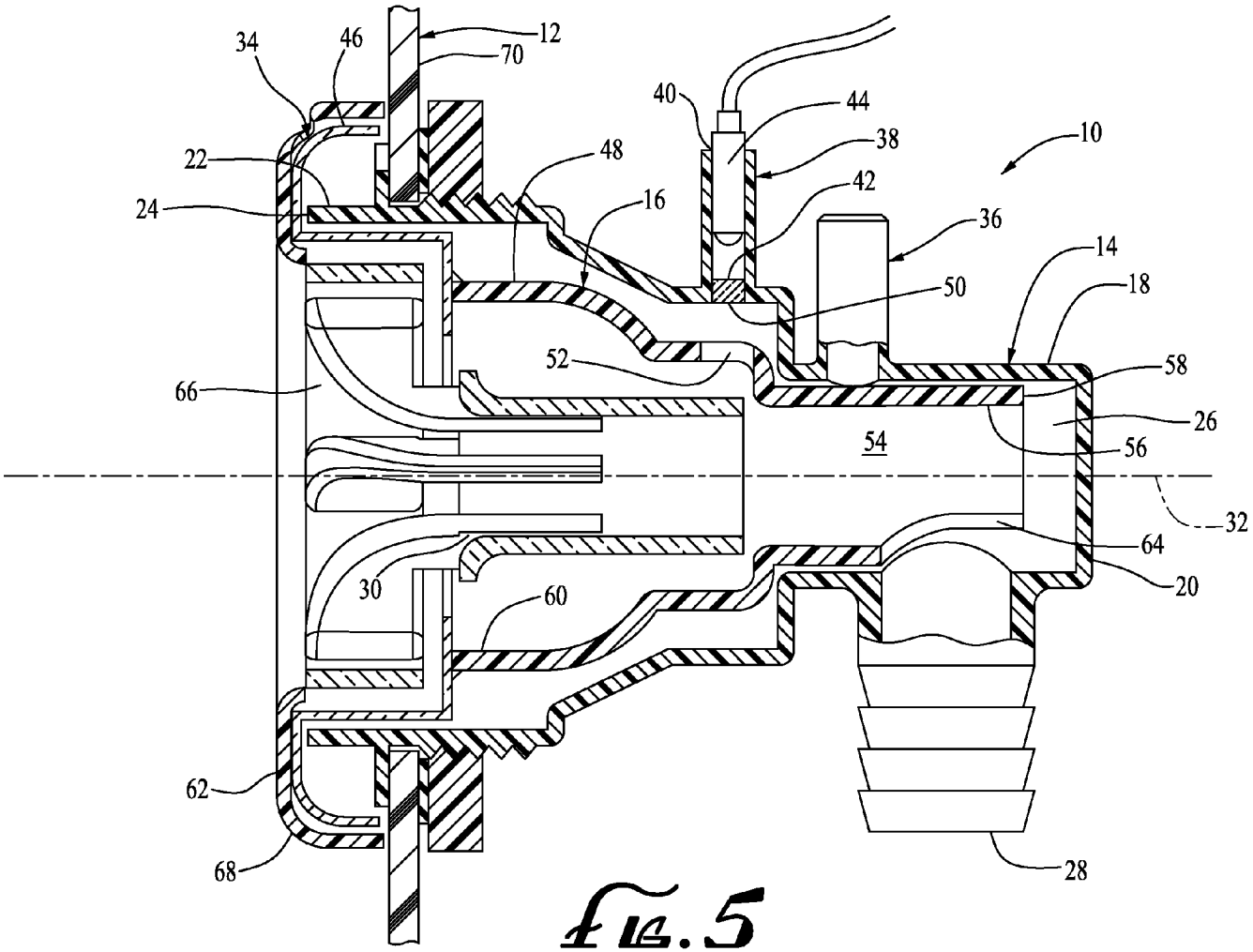
FIG. 5 is a cross-sectional view of the water recreational apparatus jet of FIG. 2.

The insert 16 is movable within the body 14 between (1) a water open position (illustrated in FIGS. 3 and 5), wherein water is allowed to flow between the body inlet opening 28 and the insert outlet opening 66, and (2) a water closed position (illustrated in FIG. 4), wherein water is prevented from flowing between the body inlet opening 28 and the insert outlet opening 66.

The insert 16 is also moveable within the body 14 between (1) a light on position (illustrated in FIGS. 3 and 5), wherein light is allowed to flow between the light well 38 and the proximal portion 60 of the insert 16, and (2) a light off position (illustrated in FIG. 4), wherein light is blocked from flowing between the light well 38 and the proximal portion 60 of the insert 16.

In the embodiment illustrated in the drawings, the water open position is the same as the light on position, and the water closed position is the same as the light off position. In another embodiment (not shown), the water open position is the same as the light off position, and the water closed position is the same as the light on position.

In the embodiment illustrated in the drawings, the insert 16 is moved to the water open position by rotating the insert 16 with respect to the body 14 in a first direction, and the insert 16 is moved to the water closed position by rotating the insert 16 with respect to the body 14 in the reverse direction.

Also in the embodiment illustrated in the drawings, the rotation of the insert 16 to the water open position allows the insert interior passageway 54 to be in fluid communication with the body interior passageway 26, and the rotation of the insert 16 to the water closed position prevents the insert internal passageway 54 from being in fluid communication with the body interior passageway 26.

In the embodiment illustrated in the drawings, the rotation of the insert 16 to the light on position allows the insert lateral aperture 52 to be disposed immediately opposite the closed transparent end 42 of the light well 38, and moving the insert 16 to the light off position rotates the insert lateral aperture 52 away from the closed transparent end of the light well 38.

In operation, the water jet 10 of the invention is disposed within a wall 70 of a water recreational apparatus 12 with the proximal portion 22 of the jet body 14 facing the interior of the water recreational apparatus 12 and with the distal end 24 of the water body 14 disposed outside the interior of the water recreational apparatus 12. The inlet opening 28 in the body 14 is connected in fluid tight communication with a source of pressurized water, the air inlet port 36 is connected to a source of pressurized air, and a light, such as an LED, is disposed within the light well 38, operatively connected to a source of electrical power. With embodiments such as illustrated in the drawings, the insert 16 is then moved to both the water open position and the light on position by rotating the flange cover 68 until the insert interior passageway 54 is disposed in fluid communication with the body interior passageway 26 and the insert lateral aperture 52 is disposed immediately opposite the closed internal end 42 of the light well 38. Thus, in this water open/light on position, water is free to flow from the inlet opening 28 in the body 14 through the insert interior passageway 54 and out into the interior of the water recreational apparatus 12 through the insert outlet opening 66. Also, in this water open/light on position, light rays from the light within the light well 38 is projected through the closed internal end 42 of the light well 38, through the insert lateral aperture 52, into the interior of the insert interior passageway 54, and can thereby be seen by individuals disposed within the water recreational apparatus 12. The insert 16 can then be moved to both the water closed and light off position by rotating the flange cover 68 to the water closed position (whereby the insert internal passageway 54 is moved out of fluid communication with the body interior passageway 54), and the light off position (whereby the insert lateral aperture 52 is rotated away from the closed internal end 42 of the light well 38). In this water closed/light off position, neither water nor light flows through the water jet 10.

The invention is contrasted with the water jet 110 of the prior art illustrated in FIG. 1. The water jet 110 illustrated in FIG. 1 also has a body 114 with a rotatable insert 116 disposed therein. The body 114 has an inlet opening 128 as does the insert 116 (element number 164) to allow water to flow from the distal end 120 of the body 114, into the insert 116, through an insert interior passageway 154 and out an open proximal end 166 of the insert. In the jet 110 illustrated in FIG. 1, unlike in the jet 10 of the invention, a light well 138 is disposed along the longitudinal axis of the body 114 from the distal end 120 of the body 114 a substantial distance along the water flow path within the insert interior passageway 154. Such design tends to create leaking problems where the light well 138 enters the distal end 120 of the body 114. Also, the light well 138 disposed along the water flow path within the insert interior passageway 154 substantially inhibits the flow of water through the insert interior passageway 154.

Since the jet of the invention requires no light well disposed within the water flow path through the jet, the possibility of leaks formed around connections with the light well are eliminated. Also, restrictions within the flow path caused by the presence of the light well within the flow path are also eliminated.

The invention offers other advantages, as well. One such other advantage is that the illumination from the light within the light well flowing through the jet works "in harmony" with the flow of water through the jet. Another such advantage of the invention is that the invention allows the user to quickly identify whether the jet is in the water on position or the water off position.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A water jet suitable for use in a water recreational apparatus, the water jet comprising:

a body having a distal portion terminating at a distal end of the body and a proximal portion terminating at a proximal end of the body, the body defining a body interior passageway between a body inlet opening in the distal portion of the body and a body outlet opening in the proximal portion, and having a longitudinal axis between the body distal end and the body proximal end, the proximal portion of the body defining a peripheral flange at the proximal end of the body, the peripheral flange surrounding the body outlet opening, the body further defining a light well disposed along a side of the body and oriented to be generally perpendicular to the longitudinal axis, the light well having an open external end and a closed transparent internal end, the light well having a size selected to receive a light source oriented so as to project light towards the body interior passageway; and an insert movably attached to the body, the insert having a distal portion terminating at a distal end of the insert and a proximal portion terminating at a proximal end of the insert, the insert defining an insert interior passageway between an insert inlet opening in the distal portion of the insert and an insert outlet opening in the proximal portion of the insert, the insert defining a flange cover at the proximal end of the insert, the distal portion of the insert being disposed within the interior passageway of the body with the flange cover disposed over the peripheral flange of the body, the insert inlet opening having a size and a shape selected to receive water from the body inlet opening when the insert is moved to a water open position in the body at which the insert inlet opening is aligned with the body inlet opening so that water may then flow through the insert inlet opening to the insert outlet opening, and wherein the insert inlet opening size and shape are also selected to prevent water from being received at the insert inlet opening when moved to a water closed position in the body at which the inlet opening is misaligned with the body inlet opening and water is thereby prevented from flowing between the body inlet opening and the insert outlet opening, and the insert is moveable within the body to a light on position at which the insert does not block light projected from the light well and light from the light well is projected between the light well and the proximal portion of the insert, and the insert is moveable within the body to a light off position at which the insert blocks light from the light well and light is not projected between the light well and the proximal portion of the insert.

2. The water jet of claim 1 wherein the water open position of the insert is the same as the light on position, and the water closed position is the same as the light off position.

3. The water jet of claim 1 wherein the body comprises a translucent area in the peripheral flange and a translucent passageway between the light well and the translucent area in the flange.

4. The water jet of claim 1 wherein the body is made from a translucent material and the insert is made from an opaque material.

5. The water jet of claim 1 wherein the insert is moved to the water open position by rotating the insert with respect to the body in a first direction, and the insert is moved to the water closed position by rotating the insert with respect to the body in the reverse direction.

6. The water jet of claim 5 wherein the rotation of the insert to the water open position allows the insert inlet opening to be aligned with the body inlet opening, and the rotation of the insert to the water closed position prevents the insert inlet opening from being in fluid communication with the body inlet opening.

7. The water jet of claim 6 wherein the insert defines an insert lateral opening to the insert internal passageway, the rotation of the insert to the light on position allows the insert lateral opening to be disposed immediately opposite the transparent internal end of the light well, and moving the insert to the light off position rotates the insert lateral opening away from the transparent internal end of the light well.

8. The water jet of claim 7 wherein the water open position of the insert is the same as the light on position, and the water closed position is the same as the light off position.

9. The water jet of claim 1 wherein the light well is sized and dimensioned to accept an LED light source.

10. A water recreational apparatus comprising:

a water basin of sufficient size to accommodate at least one user, the water basin having side walls; and at least one water jet disposed within a side wall of the water basin, the water jet comprising:

a body having a distal portion terminating at a distal end of the body and a proximal portion terminating at a proximal end of the body, the body defining a body interior passageway between a body inlet opening in the distal portion of the body and a body outlet opening in the proximal portion, and having a longitudinal axis between the body distal end and the body proximal end, the proximal portion of the body defining a peripheral flange at the proximal end of the body, the peripheral flange surrounding the body outlet opening, the body further defining a light well disposed along a side of the body and oriented to be generally perpendicular to the longitudinal axis, the light well having an open external end and a closed transparent internal end, the light well having a size selected to receive a light source oriented so as to project light towards the body interior passageway; and an insert movably attached to the body, the insert having a distal portion terminating at a distal end of the insert and a proximal portion terminating at a proximal end of the insert, the insert defining an insert interior passageway between an insert inlet opening in the distal portion of the insert and an insert outlet opening in the proximal portion of the insert, the insert defining a flange cover at the proximal end of the insert, the distal portion of the insert being disposed within the interior passageway of the body with the flange cover disposed over the peripheral flange of the body, the insert inlet opening having a size and a shape selected to receive water from the body inlet opening when the insert is moved to a water open position in the body at which the insert inlet opening is aligned with the body inlet opening so that water may then flow through the insert inlet opening to the insert outlet opening, and wherein the insert inlet opening size and shape are also selected to prevent water from being received at the insert inlet opening when moved to a water closed position in the body at which the inlet opening is misaligned with the body inlet opening and water is thereby prevented from flowing between the body inlet opening and the insert outlet opening, and the insert is moveable within the body to a light on position at which the insert does not block light projected from the light well and light from the light well is projected between the light well and the proximal portion of the insert, and the insert is moveable within the body to a light off position at which the insert blocks light from the light well and light is not projected between the light well and the proximal portion of the insert.

11. A water recreational apparatus of claim 10 wherein the body comprises a translucent area in the peripheral flange and a translucent passageway between the light well and the translucent area in the flange.

12. A water recreational apparatus of claim 1 wherein the body is made from a translucent material and the insert is made from an opaque material.

13. A water recreational apparatus of claim 1 wherein the insert is moved to the water open position by rotating the insert with respect to the body in a first direction, and the insert is moved to the water closed position by rotating the insert with respect to the body in the reverse direction.

14. A water recreational apparatus of claim 13 wherein the rotation of the insert to the water open position allows the insert inlet opening to be aligned with the body inlet opening, and the rotation of the insert to the water closed position prevents the insert inlet opening from being in fluid communication with the body inlet opening.

15. A water recreational apparatus of claim 14 wherein the insert defines an insert lateral opening to the insert internal passageway, the rotation of the insert to the light on position allows the insert lateral opening to be disposed immediately opposite the transparent internal end of the light well, and moving the insert to the light off position rotates the insert lateral opening away from the transparent internal end of the light well.

16. A water recreational apparatus of claim 15 wherein the water open position of the insert is the same as the light on position, and the water closed position is the same as the light off position.

17. A water recreational apparatus of claim 10 wherein the light well is sized and dimensioned to accept an LED light source.

18. The water recreational apparatus of claim 10 wherein the water open position of the insert is the same as the light on position, and the water closed position is the same as the light off position.

* * * * *